United States Patent [19]

Satake et al.

[11] Patent Number: 4,502,066

[45] Date of Patent: Feb. 26, 1985

[54] HEAT-SENSITIVE RECORDING SHEET

[75] Inventors: Toshimi Satake; Kazuo Maruyama; Fumio Fujimura, all of Tokyo, Japan

[73] Assignee: Jujo Paper Co., Ltd., Tokyo, Japan

[21] Appl. No.: 524,521

[22] Filed: Aug. 17, 1983

[30] Foreign Application Priority Data

Aug. 30, 1982 [JP] Japan ..... 57/149241

[51] Int. Cl.[3] ..... B41M 5/18

[52] U.S. Cl. ..... 346/209; 346/216; 346/217; 346/221; 346/225; 427/150; 427/151

[58] Field of Search ..... 282/27.5; 427/150–153; 428/320.4–320.8, 411, 488, 537, 913, 914, 411.1, 488.1; 346/209, 216, 217, 221, 225

[56] References Cited

FOREIGN PATENT DOCUMENTS 0116689 7/1982 Japan ..... 346/209

*Primary Examiner*—Bruce H. Hess

*Attorney, Agent, or Firm*—Koda and Androlia

[57] ABSTRACT

Heat-sensitive recording sheet comprising a base sheet and a color-forming layer including a colorless basic dyestuff and a mono-phenolic 4-hydroxyphenyl compound which is reactive with said dyestuff by heating, wherein said color-forming layer comprises a metal salt of p-alkylbenzoic acid or a metal salt of o-benzoylbenzoic acid (having a particular formula). The sheet provides superior stability against contamination with oily substances while keeping excellent fundamental qualities thereof.

10 Claims, No Drawings

HEAT-SENSITIVE RECORDING SHEET

BACKGROUND OF THE INVENTION

1. Field of the Invention

The present invention relates to a heat-sensitive recording sheet having high stability of background brightness and of developed image against oily substances such as hair oil, oil, fat, etc.

2. Prior Art

A heat-sensitive recording sheet that utilizes a thermal color-forming reaction occurring between colorless or pale-colored chromogenic dyestuff and phenolic material, or organic acid is disclosed, for example, in the Japanese Patent Publication Nos. 4160/1968 and 14039/1970 and in the Japanese Laid-Open Patent Application No. 27736/1973, and is now widely applied for practical use.

In general, a heat-sensitive recording sheet is produced by applying the sheet surface with the coating which is prepared by individually grinding and dispersing colorless chromogenic dyestuff and color-developing material such as phenolic substance into fine particles, mixing the resultant dispersions with each other and then adding thereto binder, filler, sensitizer, slipping agent and other auxiliaries. When this sheet is heated, the coating undergoes instantaneously a chemical reaction which forms a color. In this case, various bright colors can be advantageously formed depending upon selection of specific colorless chromogenic dyestuff.

These heat-sensitive recording sheets have now been found in a wide range of applications, including medical or industrial measurement recording instruments, terminal printers of computer and information communication systems, facsimile equipments, printers of electronic calculators, automatic ticket vending machines and so on. And the requirements for improving following basic properties are increasing: (1) high image density and clear image, (2) no accumulated residues, no sticking etc., (3) superior recording aptitude and less decline of brightness in the time elapsed, and so on.

The applicant has already disclosed in Japanese Patent Laid-Open No. 144193/1981 and Japanese Patent Application No. 55974/1982 that a heat-sensitive recording sheet comprising a mono-phenolic 4-hydroxyphenyl compound such as 4-hydroxybenzoic acid ester and 4-hydroxyphthalic acid diester as a color developer in combination with a fluoran type dyestuff is excellent in the above-mentioned fundamental quality.

Heat-sensitive recording sheets are inevitably in contact with human hands in view of the function thereof as information recording sheets. Since oily substances such as conventionally used hair cosmetics or oil and fats contained in sweats appearing on skins often adhere to the hands and fingers, the heat-sensitive recording sheets may frequently be contaminated by these oily substances. By the way, since heat-sensitive recording sheets are not generally so stable against these oily substances, image density in the contaminated area may be reduced or sometimes be eliminated utterly, or discoloration occurs in the contaminated white area. Although the reasons for the above phenomena have not yet been cleared completely at present, it may be considered that the oily substances partially dissolve or instabilize the chromophoric layer or the chromophoric reaction products therein formed between fine particles of a colorless basic dyestuff and an organic color-developing agent.

As mentioned above, it has been found that although the heat-sensitive recording sheet comprising 4-hydroxy-benzoic acid ester or 4-hydroxyphthalic acid diester as a color-developing agent is excellent in fundamental qualities, its stability against oily substances is somewhat inferior to that of bisphenol type color-developing agent customarily used so far.

SUMMARY OF THE INVENTION

It is a general object of the present invention to provide a heat-sensitive recording sheet in which a mono-phenolic 4-hydroxyphenyl compound is used as a color-developing agent so that the sheet is stable against contamination with oily substances while keeping excellent fundamental qualities thereof, particularly, the stability of the brightness of background and the high image density.

The above-mentioned object can be performed by adding, into the color-forming layer having a mono-phenolic 4-hydroxyphenyl compound as a color-developing agent, a metal salt of p-alkylbenzoic acid or a metal salt of o-benzoylbenzoic acid represented by the following formula:

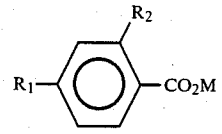

(where $R_1$ represents H, $CH_3$, $C_2H_5$, $C_3H_7$, iso-$C_3H_7$, tert —$C_4H_9$, $C_5H_{11}$,

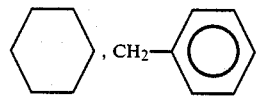

or $C_6H_5$, providing that $R_2$ represents CO—$C_6H_5$ if $R_1$ is H, or $R_2$ represents H in other cases, and M represents a polyvalene metal).

DETAILED DESCRIPTION OF THE INVENTION

It is generally considered that all of the acidic solid materials more or less develop colors when they come in contact with colorless basic dyestuffs. Therefore, organic carboxylic acids or metal salts thereof, as well as acidic clay substances such as active white clay, zeolite and attapulgite are also believed to be used as a color-developing agent for heat-sensitive recording sheets. However, the use of organic carboxylic acids as a color-developing agent in a heat-sensitive process can provide no desired image density because of their high melting point and the insufficient color developing effect. Further, since they are often water soluble, there is another problem of damaging the background color under highly humidic condition. On the other hand, those materials of salicylic acid containing phenolic-OH and carboxyl groups, although having high color-developing effect, provide a fetal defect of color-developing merely upon contact with oils and fats. Furthermore, a metal salt of benzoic acid examplified in Japanese Patent Laid-Open No. 6795/1982 can not provide stabilized background color under highly humidic condition.

The present inventors have found that a heat-sensitive recording sheet having stable color images and stable background color even under the highly humidic condition can be obtained by selecting, aside from the color-developing agent, a metal salt of p-alkylbenzoic acid or a metal salt of o-benzoylbenzoic acid of a restricted structure from various metal salts of organic carboxylic acids and combining the thus selected stabilizer together with a mono-phenolic 4-hydroxyphenyl compound, and have accomplished the present invention based on such findings.

This invention will now be described more specifically. Mono-phenolic 4-hydroxyphenyl compounds to be used as the color-developing agent in this invention include, for example, 4-hydroxybenzoic acid esters such as ethyl 4-hydroxybenzoate, propyl 4-hydroxybenzoate, iso-propyl 4-hydroxybenzoate, butyl 4-hydroxybenzoate, iso-butyl 4-hydroxybenzoate, benzyl 4-hydroxybenzoate and methylbenzyl 4-hydroxybenzoate; 4-hydroxyphthalic acid diesters such as dimethyl 4-hydroxyphthalate, diisopropyl 4-hydroxyphthalate, dibenzyl 4-hydroxyphthalate and dihexyl 4-hydroxyphthalate; and 4-hydroxyacetophenone, p-phenylphenol, benzyl 4-hydroxyphenyl acetate and p-benzylphenol; 4-hydroxy-butoxy-diophenylsulfone and 4-hydroxy-4'-methyl diphenylsulfone.

As colorless basic dyestuffs for use in this invention which are usually colorless or of pale color, various types of dyestuff are well-known and can be used with no particular restriction. For instance, colorless fluoran type duystuffs include the followings: 3-diethyl-amino-6-methyl-7-anilinofluoran (black), 3-(N-ethyl-p-toluidino)-6-methyl-7-anilinofluoran (black), 3-diethylamino-6-methyl-7-(o-, p-dimethylanilino)fluoran (black), 3-pyrrolidino-6-methyl-7-anilinofluoran (black), 3-piperidino-6-methyl-7-anilinofluoran (black), 3-(N-cyclohexyl-N-methylamino)-6-methyl-7-anilinofluoran (black), 3-diethylamino-7-(methatrifluoromethylanilino)fluoran (black), 3-dibutylamino-7-(orthochloroanilino)fluoran (black), 3-diethylamino-6-methylchlorofluoran (red), 3-diethylamino-6-methyl-fluoran (red) and 3-cyclohexyl-amino-6-chlorofluoran (orange).

Among fluoran type black color forming dyestuff, 3-diethylamino-6-methyl-(p-chloroanilino)fluoran, 3-diethylamino-7-(o-chloroanilino)fluoran, 3-(n-ethyl-p-toluidino)-6-methyl-7-anilinofluoran, 3-dibutylamino-6-methyl-(o-chloroanilino)fluoran, 3-(N-ethyl-isoamyl)-6-methyl-anilinofluoran and the like give somewhat insufficient image density even in the case where monophenolic 4-hydroxy compound is used as a color-developing agent. However, this defect can be improved by the addition of the metal salt of organic carboxylic acid specified in this invention into the color-developing layer, wherein 3-diethylamino-6-methyl-(p-chloroanilino)fluoran is particularly superior as in Example 1.

Furthermore, those colorless basic dyestuffs other than the fluoran type dyestuffs can also be used in this invention. Specifically, while it has been impossible to use crystal violet lacton, 3-(4-diethylamino-2-ethoxyphenyl)3-(1-ethyl-2-methylindole-3-yl) 4-azaphthalide and 3-(4-diethylamino-2-ethoxyphenyl)-3-(1-ethyl-2-methylindole-3-yl)-7-azaphthalide and the like in combination with the color-developing agent of monophenolic 4-hydroxyphenyl compound, since theremochromic phenomenon occurs in which the color images are eliminated immediately or gradually after the printing to make it impossible for the heat-sensitive recording sheets. However, such thermochromic phenomenon can be prevented by the use of the metal salt of organic carboxylic acid specified in this invention as a stabilizer.

The specific metal salt of organic carboxylic acid to be used as the stabilizer in this invention is the metal salt of p-alkylbenzoic acid or the metal salt of o-benzoylbenzoic acid as described above. Any polyvalent metal can be used as the metal, and zinc, calcium, magnesium, barium and lead are preferred, zinc being particularly excellent.

The organic color-developing agent and the colorless basic dyestuff, as well as the metal salt of p-alkylbonzoic acid or the metal salts of o-benzoylbenzoic acid as mentioned above are finely pulverized in a grinder such as a ball mill, an attritor, a sand grinder or the like, or in an appropriate emulsifying apparatus into fine particles of less than several micron particle size and incorporated with various type of additives depending on the purposes to prepare a coating solution. The coating solution may usually be incorporated with binders such as polyvinyl alcohol, modified polyvinyl alcohol, hydroxyethylcellulose, methylcellulose, starches, styrene-maleic anhydride copolymer, vinylacetate-maleic anhydride copolymer and styrene-butadiene copolymer, as well as organic or inorganic filler such as kaolin, calcined kaolin, diatomaceous earth, talc, titanium oxide, calcium carbonate, magnesium carbonate and aluminum hydroxide. In addition, releasing agent such as metal salt of fatty acid, lubricant such as waxes, UV-absorber of benzophenone or triazole type, water-proofing agent such as glyoxal, dispersant, defoamer or the like can also be used. By coating the solution on paper or various types of films, aimed heat-sensitive recording sheets can be obtained.

The amount of the metal salt of p-alkylbenzoic acid or the metal salt of o-benzoylbenzoic acid, as well as the kind and the amount of various other ingredients for use in this invention are determined depending on the required performances and the recording properties with no particular restriction. However, it is usually appropriate to use 3–10 parts of the organic color-developing agent, 1–8 parts of the metal salt of p-alkylbenzoic acid or the metal salt of o-benzoylbenzoic acid and 1–20 parts of the filler per one parts of the colorless basic dyestuff, and 10–25 parts of the binder for the total solid content.

This invention will now be described more specifically referring to examples.

EXAMPLE 1

| | |
|---|---|
| Solution A (liquid dispersion of dyestuff) | |
| 3-diethylamino-6-methyl-(p-chloroanilino) fluoran | 1.5 parts |
| 10% aqueous solution of polyvinyl alcohol | 3.4 parts |
| Water | 1.9 parts |
| Solution B (liquid dispersion of color-developing agent) | |
| Benzyl p-hydroxybenzoate | 6 parts |
| Zinc stearate | 1.5 parts |
| Aqueous 10% solution of polyvinyl alcohol | 18.8 parts |
| Water | 11.2 parts |
| Solution C (liquid dispersion of stabilizer) | |
| Each of stabilizers in Table 2 | 1.0 parts |
| Aqueous 10% solution of polyvinyl alcohol | 2.5 parts |

-continued

| | |
|---|---|
| Water | 1.5 parts |

Each of the solutions having the foregoing compositions was ground in a ball mill into three micron particle size. Thereafter, the liquid dispersions was mixed at a ratio shown in Table 1 to form each of coating solutions.

TABLE 1

Composition of Coating Solution in Example 1

| | Samples of the present invention (1–6) | Comparative sample (1) | Comparative samples (2–13) | Comparative samples (14–15) |
|---|---|---|---|---|
| Solution A (dyestuff dispersion) | 6.8 parts | 6.8 parts | 6.8 parts | 6.8 parts |
| Solution B (developing agent dispersion) | 37.5 parts | 37.5 parts | 37.5 parts | — |
| Solution C (stabilizer dispersion) | 5 parts | — | 5 parts | 5 parts |
| 50% calcium carbonate dispersion | 20 parts | 20 parts | 20 parts | 20 parts |

Each of the coating solutions was coated on one side of a paper substrate of 50 g/m$^2$ so as to provide a coating amount of 6.0 g/m$^2$ and was dried. The sheet was treated in a supercalendar so as to obtain a smoothness of 200–300 seconds. The results of the quality performance tests carried out for the thus obtained black-color-developed heat-sensitive recording sheets are shown in Table 2.

TABLE 2

Results of performance test in Example 1

| | Stabilizer | Optical density (1) Untreated | Optical density (1) After oil treatment (2) | Optical density (1) Residual density (%) (3) | Brightness of background (4) Untreated | Brightness of background (4) After oil treatment (5) | Brightness of background (4) Standing at 60° C., 45% RH (6) |
|---|---|---|---|---|---|---|---|
| | | | Samples of the present invention | | | | |
| 1 | lead t-butylbenzoate | 1.10 | 0.83 | 75.5 | 0.07 | 0.08 | 0.10 |
| 2 | zinc t-butylbenzoate | 1.12 | 0.95 | 84.8 | 0.08 | 0.09 | 0.10 |
| 3 | magnesium t-butylbenzoate | 1.11 | 0.83 | 74.8 | 0.07 | 0.08 | 0.12 |
| 4 | calcium t-butylbenzoate | 1.09 | 0.82 | 75.2 | 0.08 | 0.09 | 0.11 |
| 5 | lead O—benzoylbenzoate | 1.10 | 0.83 | 75.5 | 0.08 | 0.09 | 0.12 |
| 6 | zinc O—benzoylbenzoate | 1.12 | 0.96 | 85.7 | 0.07 | 0.09 | 0.09 |
| | | | Comparative samples | | | | |
| 1 | none | 1.11 | 0.17 | 15.3 | 0.08 | 0.09 | 0.09 |
| 2 | stearic acid | 1.12 | 0.15 | 13.4 | 0.08 | 0.09 | 0.11 |
| 3 | zinc stearate | 1.10 | 0.17 | 15.5 | 0.07 | 0.09 | 0.10 |
| 4 | calcium stearate | 1.07 | 0.16 | 15.0 | 0.07 | 0.09 | 0.11 |
| 5 | salicylic acid | 1.07 | 0.20 | 18.7 | 0.15 | 0.16 | 0.30 |
| 6 | zinc salicylate | 1.13 | 1.14 | 100.9 | 0.30 | 0.60 | 0.41 |
| 7 | zinc salt of a salicylic acid derivative | 1.15 | 1.18 | 102.6 | 0.12 | 1.10 | 0.42 |
| 8 | benzoic acid | 1.08 | 0.18 | 16.7 | 0.15 | 0.14 | 0.30 |
| 9 | zinc benzoate | 1.10 | 0.60 | 54.5 | 0.08 | 0.15 | 0.36 |
| 10 | calcium benzoate | 1.09 | 0.54 | 49.5 | 0.07 | 0.14 | 0.32 |
| 11 | t-butylbenzoic acid | 1.09 | 0.19 | 17.4 | 0.13 | 0.10 | 0.29 |
| 12 | P—methylbenzoic acid | 1.07 | 0.19 | 17.8 | 0.14 | 0.10 | 0.28 |
| 13 | O—benzoylbenzoic acid | 1.08 | 0.20 | 18.5 | 0.15 | 0.09 | 0.33 |
| 14 | zinc t-butylbenzoate | 0.20 | 0.18 | 90.0 | 0.07 | 0.08 | 0.09 |
| 15 | zinc O—benzoylbenzoate | 0.19 | 0.18 | 94.7 | 0.07 | 0.08 | 0.09 |

As Table 1 shows, comparative samples Nos. 14 and 15 contained no developer.

Note (1) Optical density: Measured in a heat-sensitive facsimile apparatus CP 6000, manufactured by TOSHIBA CORPORATION, using a Macbeth densitometer for the portion of evenly printed black under the condition of GIII-mode (using RD-104 amber filter, which is also used in other examples).

Note (2) Optical density after oil treatment: After spreading droplets of castor oil (0.8 mg) dropped on a glass plate by a syringe to 40 cm$^2$, they were transferred by a rubber seal of 1 cm × 1.5 cm to the surface printed and developed by the same procedures as (1) above. After leaving for seven days, the optical density in the transferred area was measured by a Macbeth densitometer.

Note (3) Residual density: Calculated by the following equation $$\text{Residual density} = \frac{\text{Optical density after oil treatment}}{\text{Optical density not oil treated}} \times 100(\%)$$

Note (4) Brightness of background: Not developed area was measured by a Macbeth densitometer.

Note (5) Brightness of background after oil treatment: Castor oil droplets were transferred onto a not developed area in the same procedures as in (2). After leaving for three days, the density on the transferred area was measured by Macbeth densitometer.

Note (6) Brightness of background after treatment at 60° C., 45% relative humidity: After leaving for 24 hours under the severe conditions of 60° C. and 45% RH, a not developed area was measured by a Macbeth densitometer.

As is apparent from Table 2, Examples of the present invention using the metal salts of t-butylbenzoic acid and the metal salts of o-benzoylbenzoic acid as the stabilizer show stable recorded images even contaminated with castor oils and possess more than 70% of residual rate for the optical density even leaving for seven days after contamination. Further, they show good stability for the brightness of background with less reduction in the brightness of background even for the oil contamination and preservation under severe conditions. Particularly, those stabilizers for use in this invention containing salts of zinc possess high residual density even after oil contaminations.

EXAMPLE 2

A solution D was prepared by replacing benzyl 4-hydroxy benzoate in the solution B of Example 1 (liquid dispersion of color-developing agent) with the identical parts by weight of dimethyl 4-hydroxyphthalate, and the solution was mixed with the solution A, the solution C, and a calcium carbonate dispersion at ratio shown in Table 3.

TABLE 3

| | Composition of the Coating Solution in Example 2 | | |
|---|---|---|---|
| | Sample of the present invention | Comparative sample (16) | Comparative sample (17–28) |
| Solution A (dyestuff dispersion) | 6.8 parts | 6.8 parts | 6.8 parts |
| Solution B (developing agent dispersion) | 37.5 parts | 37.5 parts | 37.5 parts |
| Solution C (stabilizer dispersion) | 5 parts | — | 5 parts |
| 50% calcium carbonate dispersion | 20 parts | 20 parts | 20 parts |

The results of quality performance tests for the black-color-developing heat-resistive recording sheets obtained in the same manner as in Example 1 using each of the above solutions are shown in Table 4.

TABLE 4

| | Results of performance test in Example 2 | | | | | |
|---|---|---|---|---|---|---|
| | Optical density | | | Brightness of background | | |
| Stabilizer | Untreated | After oil treatment | Residual density (%) | Untreated | After oil treatment | Standing at 60° C., 45% RH |
| | Sample of the present invention | | | | | |
| 7 lead t-butylbenzoate | 1.11 | 0.81 | 73.0 | 0.07 | 0.09 | 0.09 |
| 8 zinc t-butylbenzoate | 1.09 | 0.89 | 81.7 | 0.08 | 0.09 | 0.10 |
| 9 magnesium t-butylbenzoate | 1.10 | 0.81 | 73.6 | 0.07 | 0.09 | 0.12 |
| 10 calcium t-butylbenzoate | 1.07 | 0.80 | 74.8 | 0.08 | 0.09 | 0.12 |
| 11 lead O—benzoylbenzoate | 1.09 | 0.81 | 74.3 | 0.08 | 0.09 | 0.12 |
| 12 zinc O—benzoylbenzoate | 1.11 | 0.95 | 85.6 | 0.08 | 0.09 | 0.10 |
| | Comparative samples | | | | | |
| 16 none | 1.10 | 0.15 | 13.6 | 0.08 | 0.09 | 0.10 |
| 17 stearic acid | 1.11 | 0.14 | 12.6 | 0.08 | 0.10 | 0.11 |
| 18 zinc stearate | 1.09 | 0.16 | 14.7 | 0.08 | 0.09 | 0.09 |
| 19 calcium stearate | 1.05 | 0.14 | 13.3 | 0.08 | 0.09 | 0.11 |
| 20 salicylic acid | 1.04 | 0.21 | 20.2 | 0.10 | 0.14 | 0.28 |
| 21 zinc salicylate | 1.11 | 1.14 | 102.7 | 0.31 | 0.63 | 0.38 |
| 22 zinc salt of a salicylic acid derivative | 1.13 | 1.17 | 103.5 | 0.13 | 1.11 | 0.41 |
| 23 benzoic acid | 1.05 | 0.16 | 15.2 | 0.14 | 0.15 | 0.28 |
| 24 zinc benzoate | 1.08 | 0.61 | 56.5 | 0.09 | 0.16 | 0.37 |
| 25 calcium benzoate | 1.07 | 0.50 | 46.7 | 0.08 | 0.15 | 0.33 |
| 26 t-butylbenzoic acid | 1.06 | 0.17 | 16.0 | 0.13 | 0.11 | 0.30 |
| 27 P—methylbenzoic acid | 1.05 | 0.18 | 17.1 | 0.14 | 0.11 | 0.30 |
| 28 O—benzoylbenzoic acid | 1.01 | 0.21 | 20.8 | 0.16 | 0.10 | 0.34 |

As apparent from Table 4, examples using dimethyl 4-hydroxyphthalate as color-developing agent exhibit a remarkable effect of the stabilizer of this invention.

In table 4, the effect of the stabilizer according to the present invention is shown remarkably also in the case of using dimethyl 4-hydroxphthalate as the color-developing agent.

We claim:

1. Heat-sensitive recording sheet having a color forming layer comprising a colorless basic dyestuff and a monophenolic 4-hydroxyphenyl compound, wherein said color-forming layer contains a metal salt of p-alkylbenzoic acid having a general formula (I) or a metal salt of o-benzoylbenzoic acid having the general formula (I)

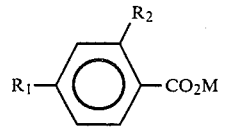

(I)

(where $R_1$ represents H, $CH_3$, $C_2H_5$, $C_3H_7$, iso-$C_3H_7$, tert-$C_4H_9$, $C_5H_{11}$,

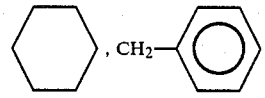

or $C_6H_5$, providing that $R_2$ represents CO—$C_6H_5$ in the case of $R_1$ is H, or $R_2$ represents H in other cases, and M represents a polyvalent metal).

2. Heat-sensitive recording sheet according to claim 1, in which the colorless basic dyestuff is at least one fluoran type dyestuff selected from the group consisting of 3-diethyl-amino-6-methyl-(p-chloroanilino)fluoran, 3-diethylamino-7-(o-chloroanilino)fluoran, 3-(N-ethyl-p-toluidino)-6-methyl-7-anilinofluoran, 3-dibutylamino-6-methyl-(o-chloroanilino)fluoran, and 3-(N-ethyl-isoamyl)-6-methyl-anilinofluoran.

3. Heat-sensitive recording sheet according to claim 2, in which the mono-phenolic 4-hydroxyphenyl compound is at least one substance selected from the group consisting of ethyl 4-hydroxybenzoate, propyl 4-hydroxybenzoate, isopropyl 4-hydroxybenzoate, butyl 4-hydroxybenzoate, iso-butyl 4-hydroxybenzoate, benzyl 4-hydroxybenzoate, and methylbenzyl 4-hydroxybenzoate.

4. Heat-sensitive recording sheet according to claim 2, in which the 4-hydroxyphthalic acid diester is at least one substance selected from the group consisting of dimethyl 4-hydroxyphthalate, diisopropyl 4-hydroxyphthalate, dibenzyl 4-hydroxyphthalate, and dihexyl 4-hydroxyphthalate.

5. Heat-sensitive recording sheet according to claim 1, in which the colorless basic dyestuff is 3-diethylamino-6-methyl-(p-chloroanilino)fluoran.

6. Heat-sensitive recording sheet according to claim 1, in which the colorless basic dyestuff is at least one substance selected from the group consisting of crystal violet lactone, 3-(4-diethylamino-2-ethoxyphenyl)-3-(1-ethyl-2-methylindole-3-yl) 4-azaphthalide, and 3-(4-diethylamino-2-ethoxyphenyl)-3-(1-ethyl-2-methyl-indole-3-yl)-7-azaphthalide.

7. Heat-sensitive recording sheet according to claim 1, in which the mono-phenolic 4-hydroxyphenyl compound is at least one substance selected from the group consisting of 4-hydroxybenzoic acid ester, 4-hydroxyphthalic acid diester, 4-hydroxyacetophenone, p-phenylphenol, benzyl 4-hydroxyphenyl acetate, p-benzylphenol, 4-hydroxy-4'-butoxy-diphenylsulfone, and 4-hydroxy-4'-methyl-diphenylsulfone.

8. Heat-sensitive recording sheet according to claim 1, in which M in the formula (I) is at least one metal selected from the group consisting of zinc, calcium, magnesium, barium, and lead.

9. Heat-sensitive recording sheet according to claim 1, in which M in the formula (I) is zinc.

10. Heat-sensitive recording sheet according to claim 1, in which the color-forming layer contains 3–10 parts by weight of the organic color developing agent, 1–8 parts by weight of the metal salt of of P-alkylbenzoic acid or the metal salt of o-benzoylbenzoic acid, 1–20 parts by weight of a filler per one part by weight of the colorless basic dyestuff, and 10–25 parts by weight of a binder for total solid content of the layer.

* * * * *